US007054130B2

(12) United States Patent
Gorczyca et al.

(10) Patent No.: US 7,054,130 B2
(45) Date of Patent: May 30, 2006

(54) APPARATUS AND METHOD FOR IMPROVING UNIFORMITY AND CHARGE DECAY TIME PERFORMANCE OF AN AIR IONIZER BLOWER

(75) Inventors: John A. Gorczyca, Lansdale, PA (US); Richard D. Rodrigo, Chalfont, PA (US)

(73) Assignee: Illinois Tool Works Inc, Glenview, IL (US)

( * ) Notice: Subject to any disclaimer, the term of this patent is extended or adjusted under 35 U.S.C. 154(b) by 236 days.

(21) Appl. No.: 10/860,396

(22) Filed: Jun. 3, 2004

(65) Prior Publication Data

US 2005/0270722 A1 Dec. 8, 2005

(51) Int. Cl.
*H01T 23/00* (2006.01)

(52) U.S. Cl. ..... 361/231; 361/230

(58) Field of Classification Search ..... 361/231, 361/230

See application file for complete search history.

(56) References Cited

U.S. PATENT DOCUMENTS 2,502,664 A * 4/1950 Nest ..... 239/402.5
2,902,209 A * 9/1959 McClatchie ..... 415/148
3,515,052 A * 6/1970 Brandes ..... 454/311
4,007,024 A * 2/1977 Sallee et al. ..... 96/65
4,376,642 A * 3/1983 Verity ..... 96/58
4,643,745 A * 2/1987 Sakakibara et al. ..... 96/76
5,055,963 A * 10/1991 Partridge ..... 361/231
5,245,503 A * 9/1993 Rodrigo ..... 361/231
5,535,089 A * 7/1996 Ford et al. ..... 361/231
5,539,187 A * 7/1996 Smith et al. ..... 219/681
6,757,150 B1 * 6/2004 Gorczyca et al. ..... 361/231
6,785,114 B1 * 8/2004 Gorczyca et al. ..... 361/231
6,850,403 B1 * 2/2005 Gefter et al. ..... 361/230

* cited by examiner

*Primary Examiner*—Brian Sircus
*Assistant Examiner*—James A. Demakis
(74) *Attorney, Agent, or Firm*—Mark W. Croll; Paul F. Donovan

(57) ABSTRACT

An air ionizer blower includes a voltage source, an air inlet, an air outlet, an air mover, at least one electrode and a straightening vane. The air mover is configured to cause air to flow into the air inlet and out of the air outlet, thereby creating an air flow. The electrode is disposed in the flow path of the air and is electrically connected to the voltage source. The electrode is configured to generate either or both of positive and negative polarity ions. The straightening vane is disposed in the air flow and attenuates loss-causing air flow patterns by redirecting the loss-causing air flow toward a single output direction and redirects portions of the air flow having other trajectories toward the single output direction. The straightening vane has a plurality of uniformly distributed apertures, each having a depth that is a function of the open area of the aperture.

41 Claims, 8 Drawing Sheets

APPARATUS AND METHOD FOR IMPROVING UNIFORMITY AND CHARGE DECAY TIME PERFORMANCE OF AN AIR IONIZER BLOWER

BACKGROUND OF THE INVENTION

The present invention is directed to air ion generators and, more specifically, to an apparatus and method for improving uniformity and charge decay time performance of an air ionizer blower by redirecting discharged air flow patterns being discharged therefrom.

In many manufacturing and processing environments, it is desirable to prevent the accumulation of charge within a workspace. To prevent the accumulation of charge both positive and negative ions are guided into the workspace to neutralize any charge which may be building up. One example of an industry in which the accumulation of charge in production areas must be avoided is the disk drive industry where it is critical to maintain high manufacturing yields.

Air ionization is an effective method of eliminating static charges on non-conductive materials and isolated conductors. Air ionizers generate large quantities of positive and negative ions in the surrounding atmosphere which serve as mobile carriers of charge in the air. As ions flow through the air, they are attracted to oppositely charged particles and surfaces. Neutralization of electrostatically charged surfaces can be rapidly achieved through the process.

Additionally, many air cleaners and ambient air ionization units also produce ions of either positive, but more typically, negative polarity.

Air ionization may be performed using electrical ionizers which generate ions in a process known as corona discharge. Electrical ionizers generate air ions through this process by intensifying an electric field around a sharp point until it overcomes the dielectric strength of the surrounding air. Negative corona occurs when electrons are flowing from the electrode into the surrounding air. Positive corona occurs as a result of the flow of electrons from the air molecules into the electrode.

One important factor in ion generation is how rapidly ions can be transferred from the tip of an ionizing pin into an air stream, and ultimately to the desired workspace or target. An emitter assembly is commonly used in ion air blower which emits either or both of positive and negative polarity ions. The emitter assembly is mounted in an air flow path so that air is propelled through an air guide such as an annular ring formed by the interior walls of an ionizer housing. FIGS. 4–5 depict a prior art air ionizer blower 50 having a housing 52 and a conventional finger-guard 51 disposed over an outlet of the air ionizer blower 50. Ionizing pins or other electrodes extend generally radially inwardly from the annular ring so that their tips are positioned in the air flow to allow ions to be blown off or drawn off of the ionizing pins and out of the ion air blower 50 which houses the emitter assembly. It is common to use an air mover, such as a rotary-hub fan or axial fan or tube-axial fan, to drive or draw air through the air ionizer blower 50. One drawback of the conventional finger-guard 51, as demonstrated in FIG. 4, is that the air that is not directed in a particular direction, and therefore, loss-causing air flow patterns such as eddy currents, swirls, vortices, rotational swirls and non-linear trajectories detract from or inhibit the air flow directed toward the work space. Further, some of the air flow that is not even loss-causing, has a trajectory other than toward the work space or target.

The typical air flow output of an axial fan has some velocity in the direction away from the fan (X direction, perpendicular to the face of the fan) and velocity elements in the tangential directions (Y-Z plane, parallel to the face of the unit). The net effect is for the air coming from the fan to have significant swirl. Fan swirl is well understood and modeled by computational fluid dynamics. For an application such as an ionizer (see, for example, prior art air ionizer blower 50 in FIG. 4) where the output of the axial fan is used to target a critical area, the tangential velocity components of the fan swirl are undesirable, as they lack directionality towards the work space or target area. Commercially available fan guards, such as conventional fan finger-guard 51 (FIG. 4) are comprised of elements with rounded or oval cross sections. In the case of wire form finger-guards 51, the rounded metal elements minimize resistance to air flow in any direction. Similarly, plastic finger-guards 51 do little to impact the directionality of the output air flow. In either case, this relatively isotropic resistance to the air allows flow to move away from the fan with little impact on velocity components tangential to the output direction of the ionizer.

Because the air flow does not reach the work space target rapidly or thoroughly, the ions are not transported to the work space or target efficiently. Additionally, in the case of bipolar ionizers, the loss-causing air flow patterns also result in the recombination and/or cancellation of positively and negatively charged ions further detracting from the efficiencies of the system. Moreover, the optimal efficiency of the air mover or fan is also not fully realized because much of the discharged air that is not channeled never even reaches the work space or target.

Accordingly, it is desirable to provide an air ionizer blower configured to redirect the air flow toward the work space or target. Further, it is desirable to configure such an air ionizer blower to attenuate loss-causing air flow patterns to improve the efficiency with respect to air flow and the distance that ions are carried.

BRIEF SUMMARY OF THE INVENTION

Briefly stated, the present invention comprises an air ionizer blower that includes a voltage source, an air inlet, an air outlet, an air mover, at least one electrode and a straightening vane. The air mover is configured to cause air to flow into the air inlet and out of the air outlet, thereby creating an air flow. The at least one electrode is disposed in the flow path of the air and is electrically connected to the voltage source. The at least one electrode is configured to generate either or both of positive and negative polarity ions. The straightening vane is disposed in the path of the air flow and is configured to attenuate loss-causing air flow patterns in the air flow by redirecting the loss-causing air flow toward a single output direction and to redirect portions of the air flow having a trajectory other than that of the single output direction toward the single output direction. The straightening vane has a plurality of generally uniformly distributed apertures. Each aperture has a depth that is a function of the overall open area of the aperture.

The present invention also comprises a bipolar air ionizer apparatus that includes an air inlet, an air outlet, a high voltage source, first and second electrodes, an air mover and a straightening vane. The high voltage source has a positive high voltage output and a negative high voltage output. The first electrode is electrically connected to the positive high voltage output and is configured to generate positive polarity ions. The second electrode is electrically connected to the negative high voltage output and is configured to generate negative polarity ions. The air mover causes air to flow into the bipolar air ionizer through the air inlet, around the electrodes and out of the bipolar air ionizer through the air outlet, thereby creating an air flow. The straightening vane is disposed in the path of the air flow and is configured to attenuate loss-causing air flow patterns in the air flow by redirecting the loss-causing air flow toward a single output direction and to redirect portions of the air flow having a trajectory other than that of the single output direction toward the single output direction. The straightening vane has a plurality of generally uniformly distributed apertures. Each aperture has a depth that is a function of the overall open area of the aperture. The straightening vane is positioned over at least one of the air inlet, the air outlet and the electrodes, such that air flowing into the air inlet, air flowing out of the air outlet or air flowing past the electrodes flows through the straightening vane.

The present invention further comprises a bipolar air ionizer apparatus that includes an air inlet, an air outlet, an alternating current (AC) high voltage source, an electrode, an air mover and a straightening vane. The electrode is electrically connected to the high voltage source and is configured to alternately generate positive and negative polarity ions. The air mover causes air to flow into the bipolar air ionizer through the air inlet, around the electrodes and out of the bipolar air ionizer through the air outlet, thereby creating an air flow. The straightening vane is disposed in the path of the air flow and is configured to attenuate loss-causing air flow patterns in the air flow by redirecting the loss-causing air flow toward a single output direction and to redirect portions of the air flow having a trajectory other than that of the single output direction toward the single output direction. The straightening vane has a plurality of generally uniformly distributed apertures. Each aperture has a depth that is a function of the overall open area of the aperture. The straightening vane is positioned over at least one of the air inlet, the air outlet and the electrodes, such that air flowing into the air inlet, air flowing out of the air outlet or air flowing past the electrodes flows through the straightening vane.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
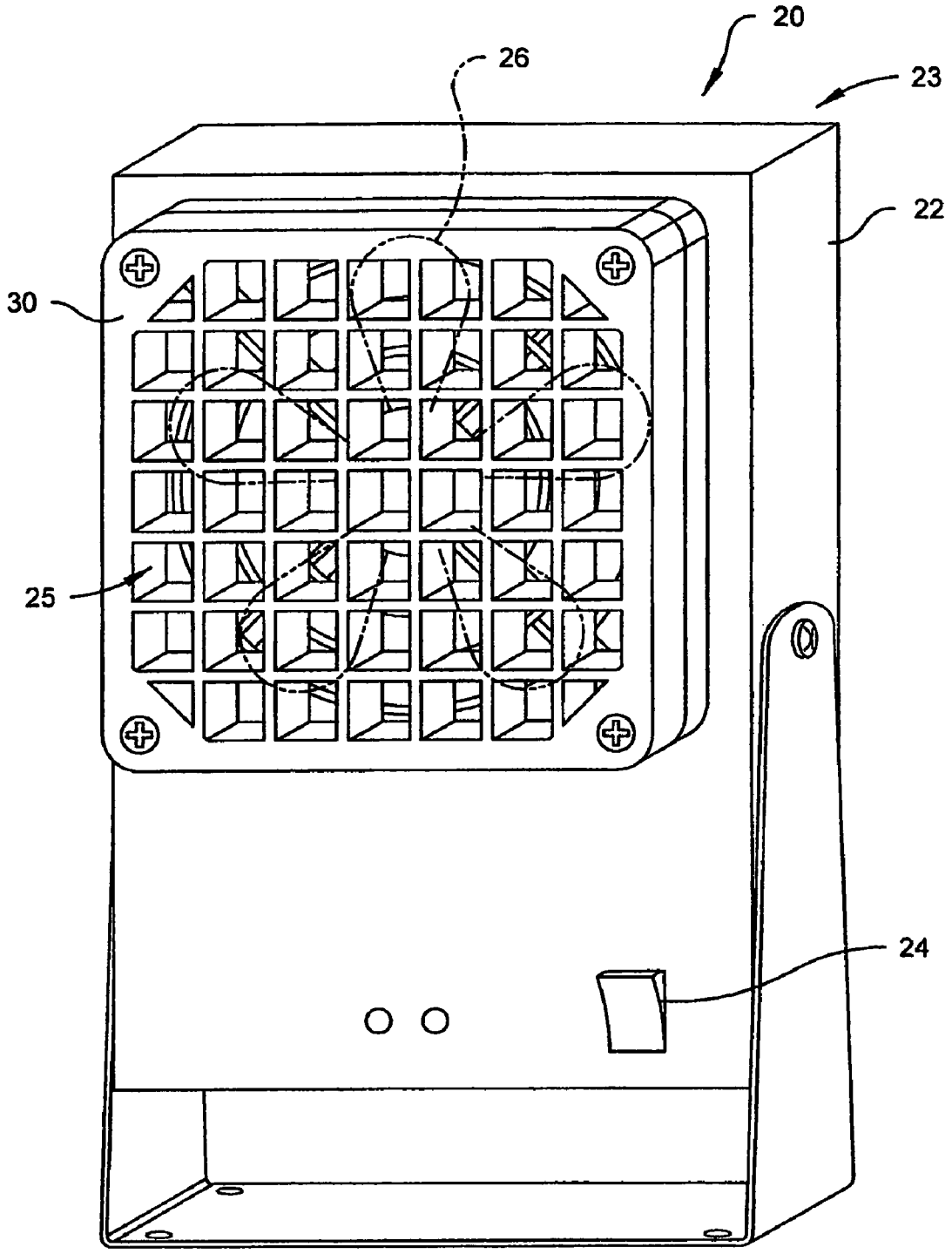
FIG. 1A is a perspective view of an air ionizer blower having a straightening vane in accordance with a first preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the element or device described and designated parts thereof. The terminology includes the words above specifically mentioned, derivatives thereof and words of similar import. Additionally, the word "a," as used in the claims and in the corresponding portions of the specification, means "one" or "at least one."

Referring to the drawings in detail, wherein like numerals represent like elements throughout, there is shown in FIGS. 1A–1B, 2–3 and 6–7, an air ionizer blower 20 having a straightening vane 30 in accordance with a first preferred embodiment of the present invention. The air ionizer blower 20 includes a voltage source 110, an air inlet 23, an air outlet 25, an air mover 26, at least one electrode 114 and the straightening vane 30.

The straightening vane 30 may be formed of an electrically conductive or non-conductive material. The straightening vane 30 may also be electrically coupled to the voltage source 110 to provide feedback control of the voltage source 110.

Figure 1B:
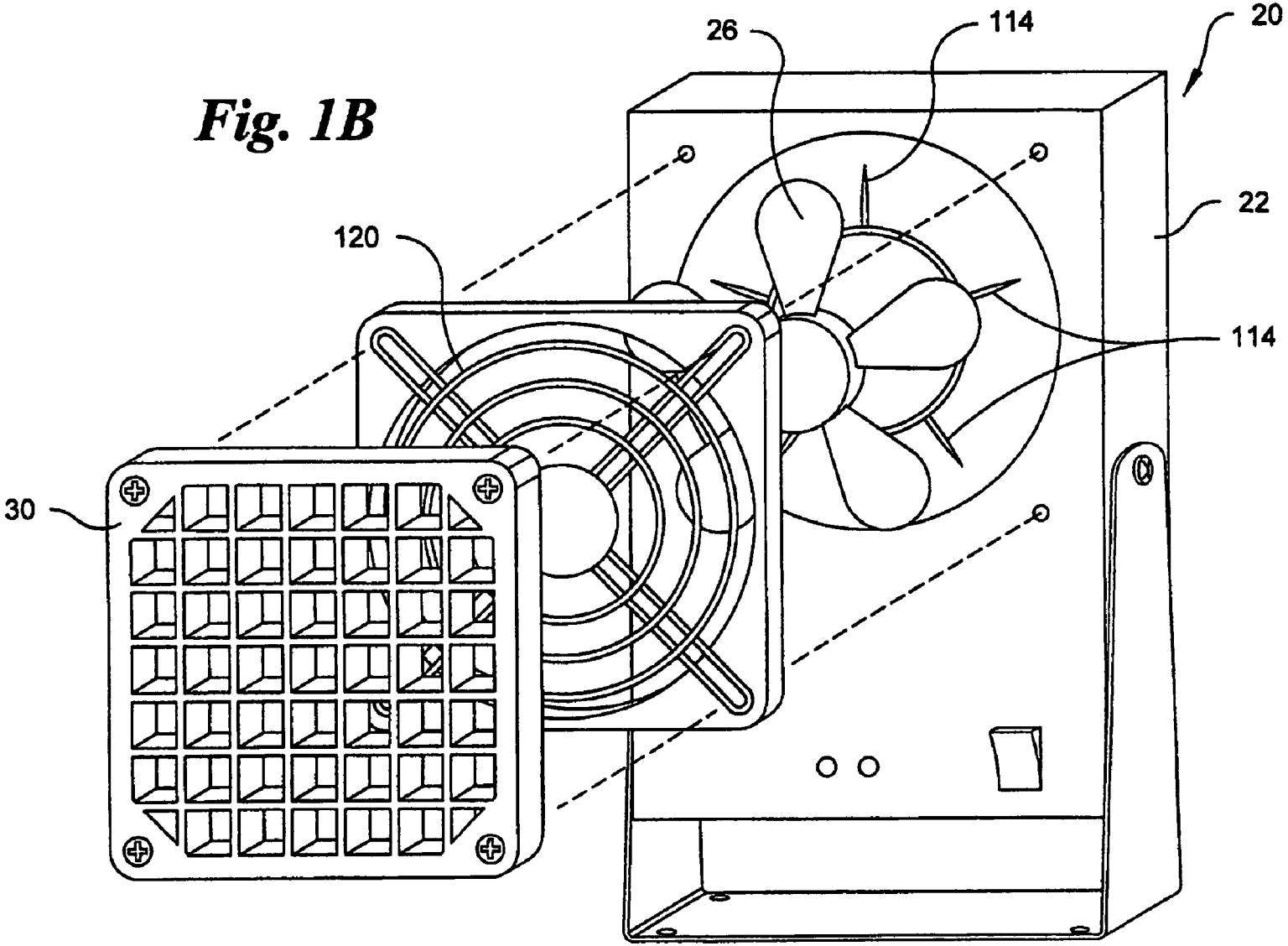
FIG. 1B is a partially exploded perspective view of the air ionizer blower of FIG. 1A depicting the major internal components.

The air mover 26 is configured to cause air to flow into the air inlet 23 and out of the air outlet 25, thereby creating an air flow. The air mover 26 may be a fan 26 such as a rotary-hub fan or axial fan or tube-axial fan (FIG. 1B). Of course, any air mover 26 can be utilized including blowers, squirrel-cage fans, sources of compressed gas, and the like, without departing from the present invention.

Figure 6:
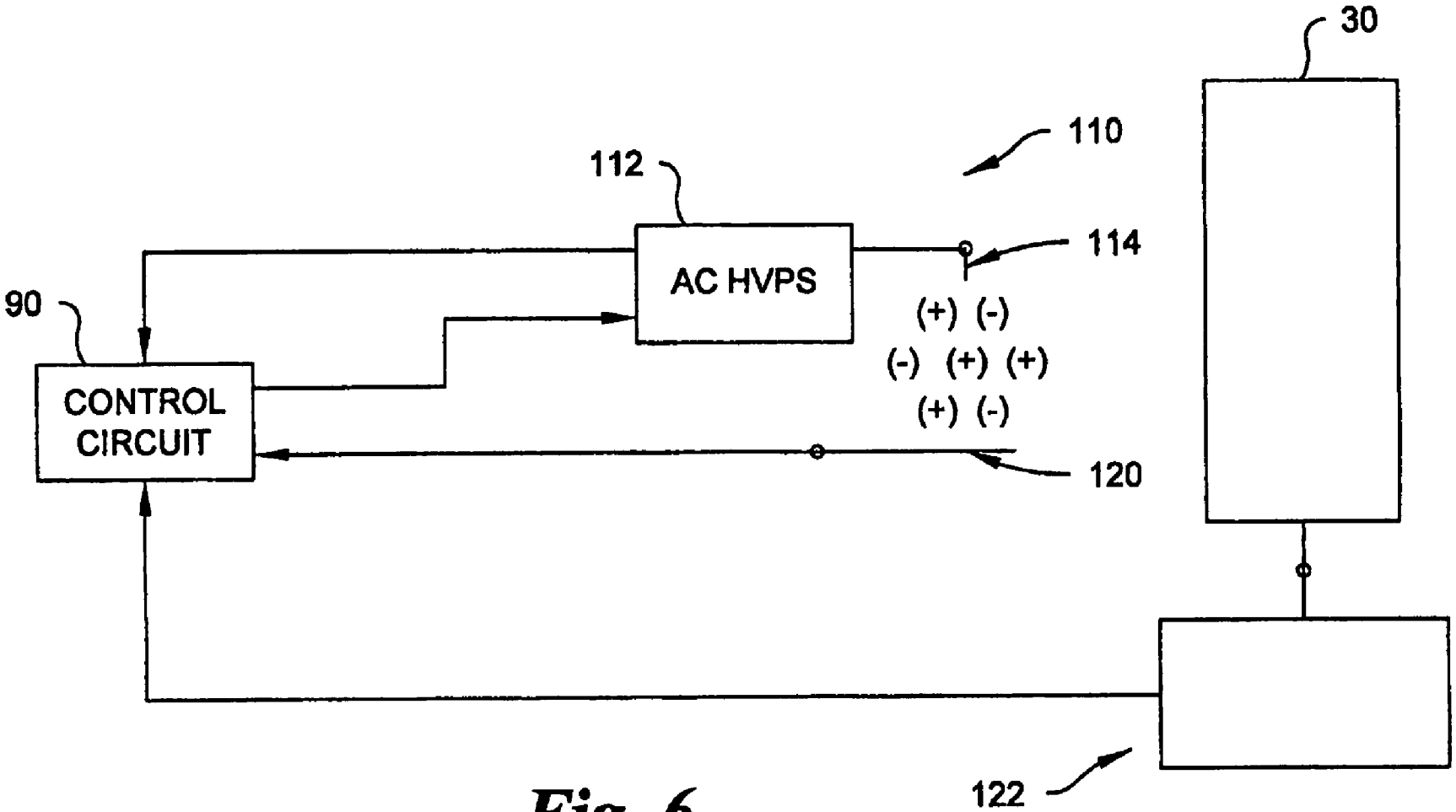
FIG. 6 is a schematic circuit diagram of an alternating current ionizer circuit in accordance with the preferred embodiments of the present invention.

The at least one electrode 114 is disposed in the flow path of the air and is electrically connected to the voltage source 110 (FIG. 6). The at least one electrode 114 is configured to generate either or both of positive (+) and negative (−) polarity ions. Preferably, there are a plurality of electrodes 114 disposed in the air ionizer blower 20 (FIG. 1B), such as ionizer pins 114 that extend radially outward from the hub of the fan 26 or radially inward toward the hub of the fan 26. Other electrodes 114 such as wires, pins, tubes and the like may be equally utilized without departing from the present invention. The electrodes 114 may be configured in other orientations upstream or downstream of the fan 26 without departing from the present invention.

The voltage source 110 includes an alternating current (AC) high voltage power supply 112 and a control circuit 90. Preferably, the AC power supply 112 is supplied with electrical power conditioned at between about seventy (70 V) and about two hundred forty (240 V) volts AC at between about fifty (50 Hz) and about sixty (60 Hz) hertz. The AC power supply 112 of the voltage source 110 can include electrical power conditioning components such as a transformer, capable of stepping up the voltage to between about five thousand (5 KV) and ten thousand (10 KV) volts AC at between about fifty (50 Hz) and about sixty (60 Hz) hertz.

The AC power supply 112 of the voltage source 110 can include electrical power conditioning components such as a rectifier that includes a diode and capacitor arrangement, capable of increasing the voltage to between about five thousand (5 KV) and ten thousand (10 KV) volts DC of either or both of positive and negative polarities. The control circuit 90 is configured to drive the AC power supply 112 based on feedback from either a sensor 120 or from the straightening vane 30. The sensor 120 detects the level of ions in the discharged air flow. The control circuit 90, implemented as a feedback circuit, is preferably used to automatically adjust the power transmitted to the electrodes 114 to adjust the level of ions contained in the air being ejected from the ion air blower. The control circuit 90 may include other components, such as integrated circuits (ICs), controllers, amplifiers and the like, for accepting feedback control and/or operator adjustments. When the straightening vane 30 is formed of a conductive material and used as the feedback sensor, an additional feedback or bias circuit 122 may be provided which includes a biasing component, such as a capacitor or resistor coupled to ground, or a capacitor, resistor, an amplifier or voltage source coupled between the straightening vane 30 and the control circuit 90.

Figure 7:
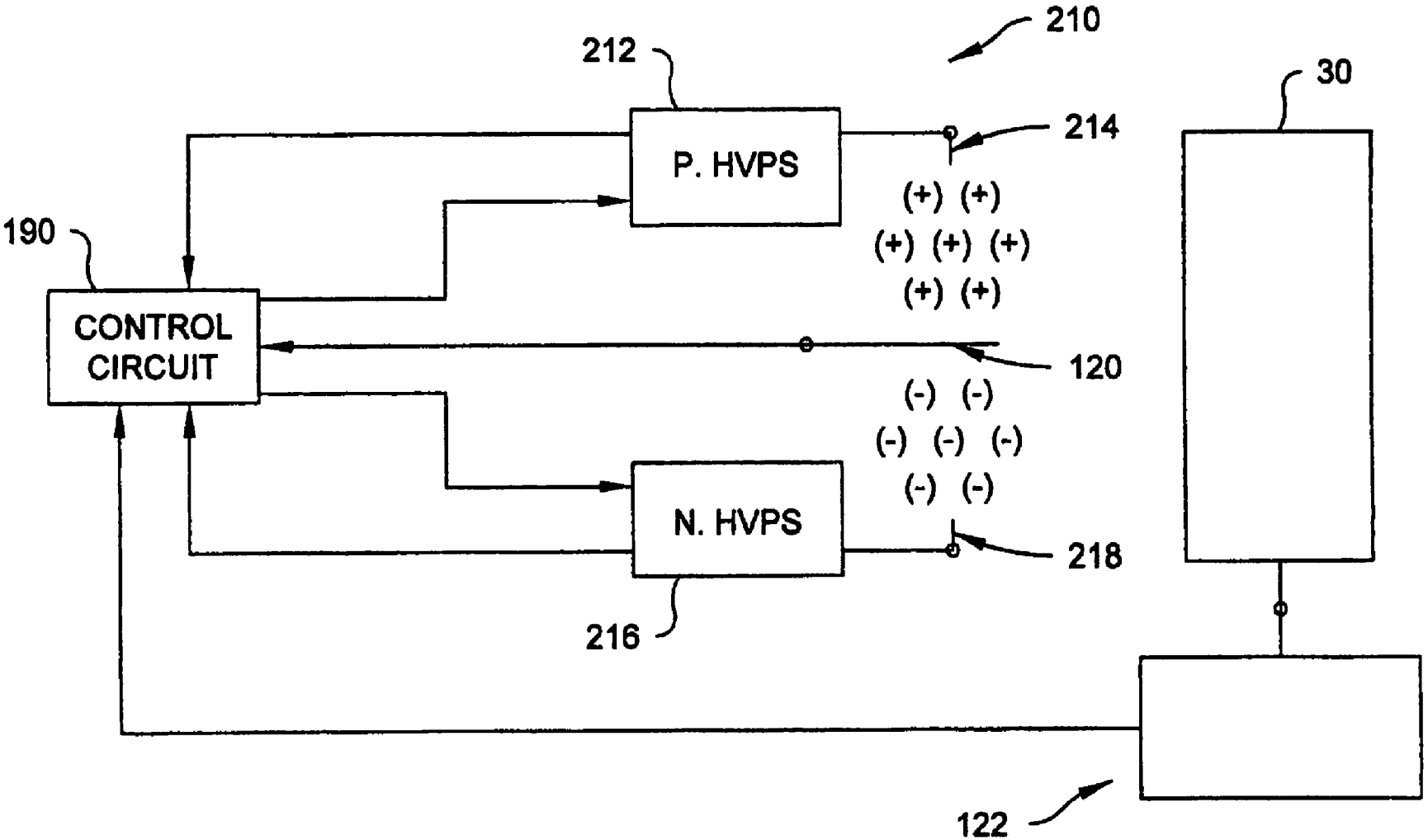
FIG. 7 is a schematic circuit diagram of a bipolar ionizer control circuit in accordance with the preferred embodiments of the present invention.

In another embodiment shown in FIG. 7, a voltage source 210 may be used which is supplied with electrical power conditioned at about twenty-four (24 V) volts DC. The voltage source 210 includes either or both of a positive high voltage power supply 212 and a negative high voltage power supply 216. The voltage source 210 may include a free standing oscillator which is used as an AC source to drive a transformer whose output is rectified, capable of conditioning the voltage to between about five thousand (5 KV) and ten thousand (10 KV) volts DC of both positive and negative polarities. In any of the embodiments, the sensor 120 may provide feedback to the voltage source 210 to control the output of the power supplies 212, 216. The control circuit 190 is configured to drive the positive and negative high voltage power supplies 212, 216 based on feedback from either the sensor 120 or from the straightening vane 30. The control circuit 190 may include components, such as integrated circuits (ICs), controllers, amplifiers and the like, for accepting feedback control and/or operator adjustments. When the straightening vane 30 is formed of a conductive material and used as the feedback sensor, an additional feedback or bias circuit 122 may be provided which includes a biasing component, such as a capacitor or resistor coupled to ground, or a capacitor, resistor, an amplifier or voltage source coupled between the straightening vane 30 and the control circuit 190.

The specifics of the particular voltage source 110, 210 used with the air ionizer blower 20 is not critical to the present invention and, accordingly, is not further detailed herein.

Figure 2:
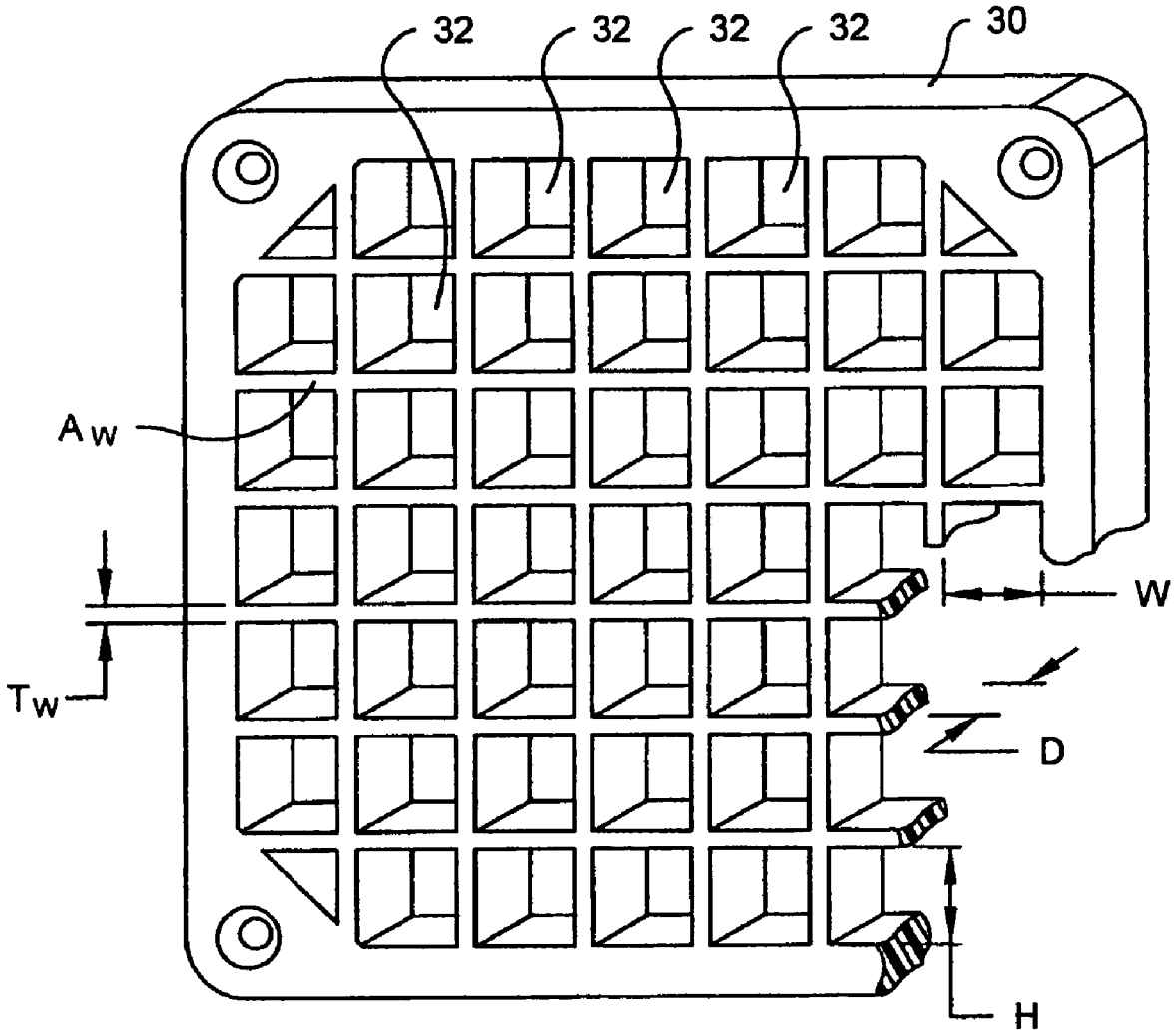
FIG. 2 is an enlarged perspective view of the straightening vane of FIG. 1A with a partially cross-sectioned portion.
Figure 3:
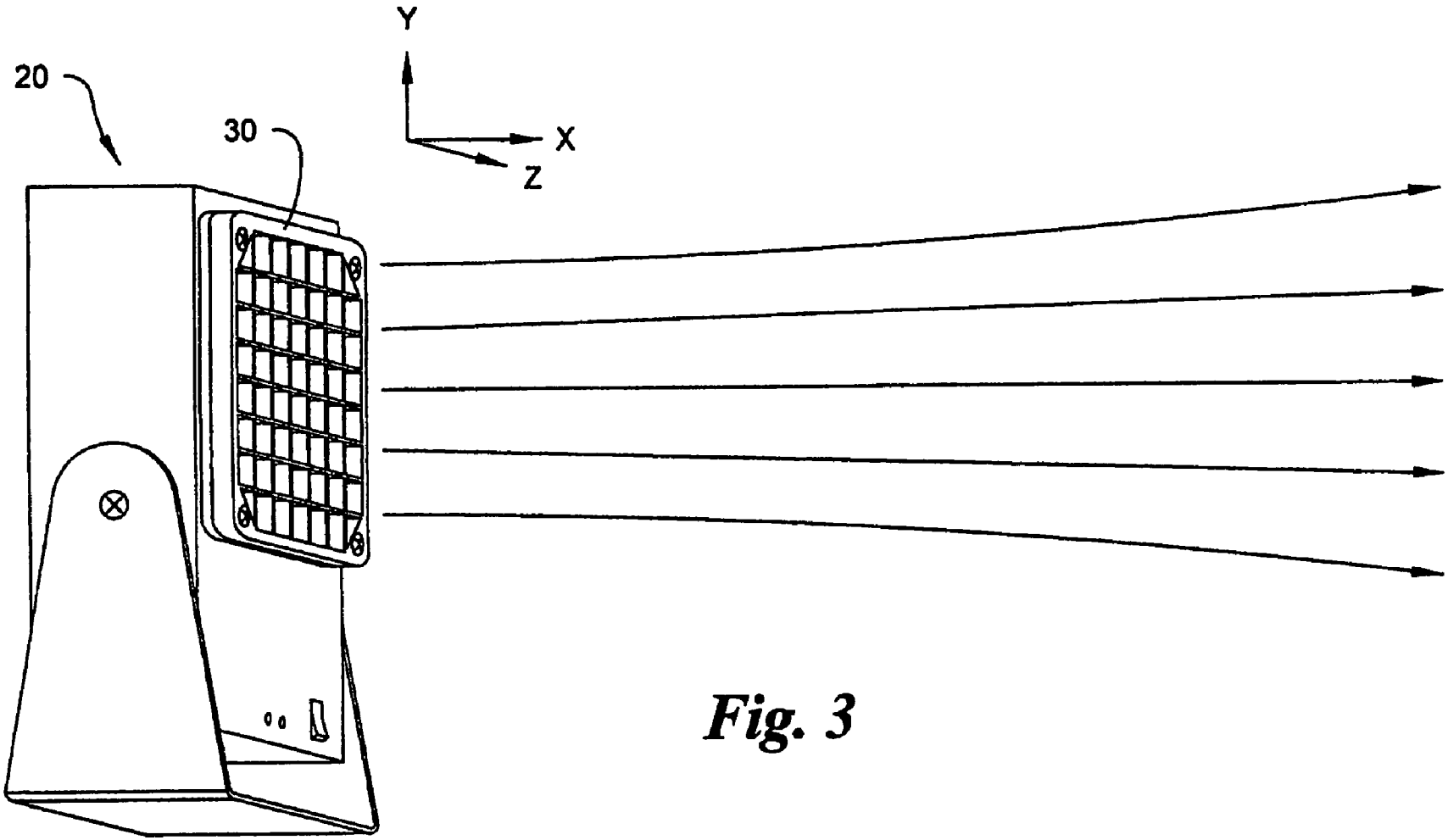
FIG. 3 is a side-perspective view of the air ionizer blower having the straightening vane of FIG. 1A and depicting a discharged air flow pattern.

The straightening vane 30 is disposed in the path of the air flow and is configured to attenuate loss-causing air flow patterns in the air flow by redirecting the undesirable loss-causing air flow toward a single output direction and to redirect portions of the air flow having a trajectory other than that of the single output direction toward the single output direction. The straightening vane 30 is positioned over at least one of the air inlet 23, the air outlet 25 and the at least one electrode 114, such that air flowing into the air inlet 23, air flowing out of the air outlet 25 or air flowing past the at least one electrode 114 flows through the straightening vane 30. The straightening vane 30 has a plurality of generally uniformly distributed apertures 32. Each aperture 32 has a height H, a width W and a depth D (FIG. 2). The depth D of each aperture 32 is preferably greater than 2 millimeters (mm) in order to provide sufficient redirection of the air flow. Preferably, each aperture 32 has a depth D that is a function of the overall open area of the aperture 32. For example, the depth D of each aperture 32 may be calculated as being at least one-half (½) times the square root of the open area of the aperture 32.

For example, in one design, a square-shaped aperture 32 having a height H of 0.5 inches (12.7 mm) and a width W of 0.5 inches (12.7 mm), a depth D of greater than 0.25 inches (~6.35 mm) was deemed to improve performance. The area for a square is height times width, or in this case Area=H×W=0.5*0.5=0.25. The square root of 0.25 is 0.5, and one-half (½) times 0.5 is 0.25.

Of course, other calculable relationships which similarly tie the open area or the length of the perimeter of the aperture 32 to the depth D may be utilized without departing from the invention. Likewise, other calculable relationships which tie the solid area of the straightening vane to the depth D of each aperture 32 may also be utilized without departing from the invention.

While depicted as square-shaped and triangular-shaped apertures 32 (FIG. 2), apertures 32 having shapes such as hexagonal (honeycomb), rectangular, circular, polygonal or other repetitive geometries can be employed in the construction of the volume resistive element or straightening vane 30 without departing from the present invention. The apertures 32 of the straightening vane 30 may be aligned in a grid or a honeycomb. Preferably, the apertures 32 of the straightening vane 30 are aligned in a symmetrical pattern with respect to the overall shape of the straightening vane 30.

By introducing a volume resistive element, namely the straightening vane 30, to the air flow, the unwanted tangential components of the output of the fan 26 can be successfully redirected. The straightening vane 30 is designed to be resistive to air with velocity components in the direction tangential (Y-Z plane) to the desired output directionality for the ionizer (X direction). At the same time, the straightening vane is designed to have minimal cross section in the desired air flow direction (X direction), minimizing the resistance to air moving in this direction. Preferably, the open face of the straightening vane 30 (i.e., with the apertures 32) is aligned in the direction of the desired air flow. The depth D of the apertures 32 is selected to offer resistance to flow in the tangential directions. The construction of the straightening vane 30 can be optimized for a particular application to eliminate or manage tangential air flow to a desired level.

The following parameters should be considered when designing a straightening vane 30 for an air ionizer blower 20:

(i) the wall thickness $T_W$ between apertures 32 should be minimized to minimize air flow resistance in the desired direction;

(ii) the overall wall area $A_W$ perpendicular to the desired air flow direction should be minimized;

(iii) increasing the depth D of the apertures 32 increases added resistance to the air moving in directions tangential to the desired direction;

(iv) the depth D of the apertures 32 can be adjusted to maintain an intermediate level of tangential velocity in the air;

(v) the depth D of the apertures 32 can be increased to a point where no addition effect of the output air directionality is yielded;

(vi) increasing the number of apertures 32 per unit area of the straightening vane 30 increases the resistance to the air moving in the tangential direction; and (vii) increasing the number of apertures 32 per unit area of the straightening vane 30 increases the resistance to the air moving in the desired direction by virtue of increased overall wall area $A_W$.

Apertures 32 having other irregular geometries (e.g., symmetrical, non-geometrical or asymmetrical shapes) may achieve the same effect of offering resistance to the air flow in the tangential directions while letting air in the perpendicular direction flow freely and of attenuating undesirable loss-causing air flow patterns.

A bipolar air ionizer apparatus 20, in accordance with a second preferred embodiment of the present invention, includes the air inlet 23, the air outlet 25, the high voltage source 210, first and second electrodes 214, 218, the air mover 26 and a straightening vane 30. The first electrode 214 is electrically connected to the positive high voltage output or power supply 212 and is configured to generate positive polarity ions. The second electrode 218 is electrically connected to the negative high voltage output or power supply 216 and is configured to generate negative polarity ions. The air mover 26 causes air to flow into the bipolar air ionizer 20 through the air inlet 23, around the electrodes 214, 218 and out of the bipolar air ionizer through the air outlet 25, thereby creating an air flow. The straightening vane 30 is disposed in the path of the air flow and is configured to attenuate loss-causing air flow patterns in the air flow by redirecting the loss-causing air flow toward a single output direction and to redirect portions of the air flow having a trajectory other than that of the single output direction toward the single output direction. The straightening vane 30 has a plurality of generally uniformly distributed apertures 32. Each aperture 32 has a depth D that is a function of the overall open area of the aperture 32. The straightening vane 30 is positioned over at least one of the air inlet 23, the air outlet 25 and the electrodes 214, 218, such that air flowing into the air inlet 23, air flowing out of the air outlet 25 or air flowing past the electrodes 214, 218 flows through the straightening vane 30.

A bipolar air ionizer apparatus 20, in accordance with a third preferred embodiment of the present invention, includes the air inlet 23, an air outlet 25, the alternating current (AC) high voltage source 110, the electrode 114, the air mover 26 and the straightening vane 30. The electrode 114 is electrically connected to the AC power supply 112 of the high voltage source 110 and is configured to alternately generate positive and negative polarity ions. The air mover 26 causes air to flow into the bipolar air ionizer 20 through the air inlet 23, around the electrodes 114 and out of the bipolar air ionizer 20 through the air outlet 25, thereby creating an air flow. Otherwise, the bipolar air ionizer apparatus 20 in accordance with the third preferred embodiment of the present invention operates similar to the second preferred embodiment of the present invention.

Concentric rings or concentric tubes or other shapes may concentrate output air into a column, similar to the straightening vane 30, and therefore, may be contemplated in alternate embodiments of the present invention. But, such designs are not as ideal for providing uniform resistance to air flow in the tangential directions (Y-Z) across their areas.

The present invention can be utilized equally well with either bipolar or monopolar air ionizer blowers 20. Furthermore, while depicted herein as being associated with a bench-top unit, the size and shape of the air ionizer blower 20 need not be limited to bench-top devices. Even further, the present invention can be utilized with other ion generators such as alpha sources, x-ray photo-ionizer and the like.

Figure 4:
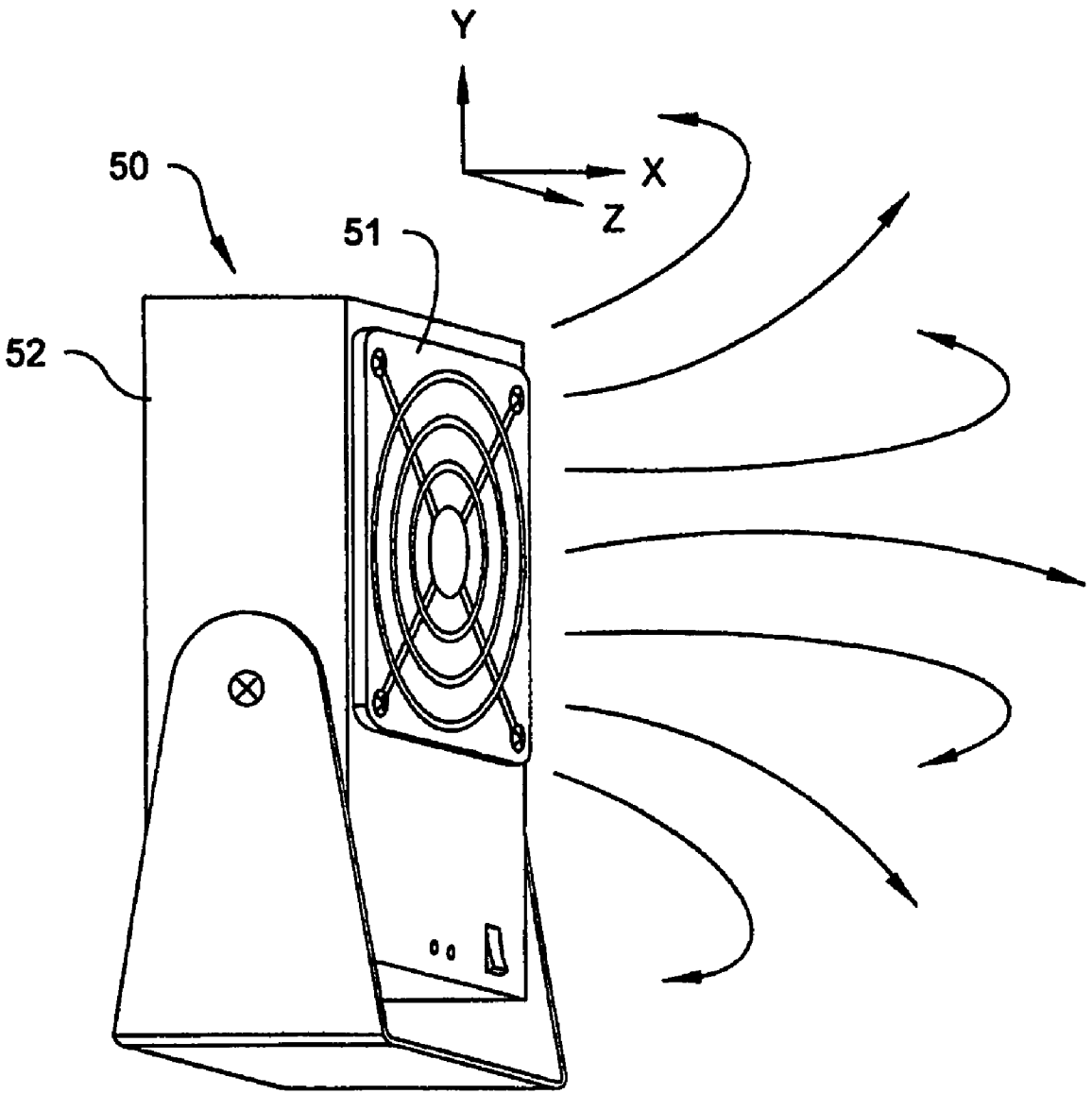
Fig. 4 (Prior Art)
FIG. 4 is a side-perspective view of a prior art air ionizer blower having a conventional finger-guard and depicting a discharged air flow pattern.
Figure 5:
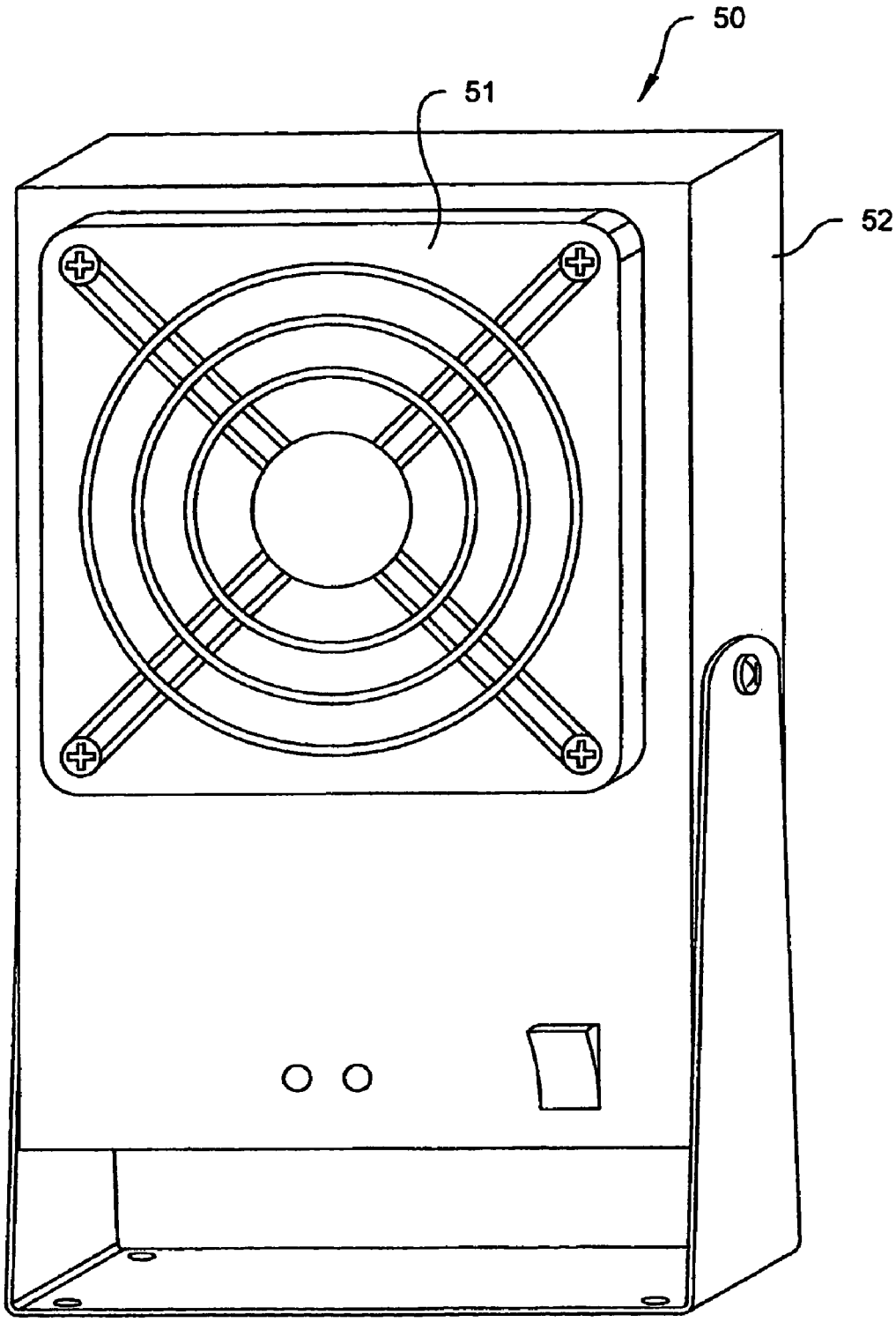
Fig. 5 (Prior Art)
FIG. 5 is a perspective view of a prior art air ionizer blower having a conventional finger-guard.

Test data from experiments comparing the prior art air ionizer blower 50 (FIG. 4) with one of the air ionizer blowers 20 (FIG. 3) in accordance with the present invention demonstrates that for a given distance, charge decay times were halved by utilizing the straightening vane 30. Further, the air ionizer blower 20 having the straightening vane 30 demonstrated the ability to reach farther distances with ionized air flow, as compared to the prior art air ionizer blower 50 with only a finger-guard 51. Furthermore, experiments with the air ionizer blower 20 having the straightening vane 30 demonstrated a measurable improvement in uniform ion balance and uniform distribution of charge decay times surrounding the area generally in-line with the axis of rotation of the fan, as compared to the prior art air ionizer blower 50 with only a finger-guard 51.

From the foregoing it can be seen that the present invention comprises air ionizer blower having a straightening vane that is configured to attenuate loss-causing air flow patterns in the air flow by redirecting the loss-causing air flow toward a single output direction and to redirect portions of the air flow having a trajectory other than that of the single output direction toward the single output direction. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An air ionizer blower comprising:

a voltage source;

an air inlet;

an air outlet;

an air mover configured to cause air to flow into the air inlet and out of the air outlet, thereby creating an air flow;

at least one electrode disposed in the flow path of the air and being electrically connected to the voltage source, the at least one electrode being configured to generate either or both of positive and negative polarity ions; and a straightening vane disposed in the path of the air flow and being configured to attenuate loss-causing air flow patterns in the air flow by redirecting the loss-causing air flow toward a single output direction and to redirect portions of the air flow having a trajectory other than that of the single output direction toward the single output direction, the straightening vane having a plurality of generally uniformly distributed apertures, each aperture having a depth that is a function of the overall open area of the aperture.

2. The air ionizer blower according to claim 1, wherein the air mover is a fan.

3. The air ionizer blower according to claim 2, wherein the fan is a rotary-hub fan or axial fan or tube-axial fan.

4. The air ionizer blower according to claim 1, wherein the straightening vane is formed of a conductive material.

5. The air ionizer blower according to claim 4, wherein the straightening vane is electrically coupled to the voltage source as a sensor to provide feedback control of the voltage source.

6. The air ionizer blower according to claim 1, wherein the straightening vane is formed of an electrically non-conductive material.

7. The air ionizer blower according to claim 1, wherein the loss-causing air flow patterns include at least one of eddy currents, rotational swirls, vortices and non-linear trajectories.

8. The air ionizer blower according to claim 1, wherein the straightening vane is positioned over at least one of the air inlet, the air outlet and the at least one electrode, such that air flowing into the air inlet, air flowing out of the air outlet or air flowing past the at least one electrode flows through the straightening vane.

9. The air ionizer blower according to claim 1, wherein the straightening vane is positioned over the air outlet.

10. The air ionizer blower according to claim 1, further comprising a sensor at the air outlet for sensing ion content of the outlet air, the sensor providing a feedback voltage that controls the voltage source.

11. The air ionizer blower according to claim 1, wherein each of the apertures are one of rectangularly-shaped, circularly-shaped, polygonally-shaped and asymmetrically-shaped.

12. The air ionizer blower according to claim 1, wherein the apertures of the straightening vane are aligned in a grid or a honeycomb.

13. The air ionizer blower according to claim 1, wherein the apertures of the straightening vane are aligned in a symmetrical pattern with respect to the overall shape of the straightening vane.

14. The air ionizer blower according to claim 1, wherein the depth of each aperture is at least two millimeters.

15. The air ionizer blower according to claim 1, wherein the depth of each aperture is at least one-half (½) times the square root of the open area of the aperture.

16. A bipolar air ionizer apparatus comprising:

an air inlet;

an air outlet;

a high voltage source having a positive high voltage output and a negative high voltage output;

a first electrode electrically connected to the positive high voltage output and configured to generate positive polarity ions;

a second electrode electrically connected to the negative high voltage output and configured to generate negative polarity ions;

an air mover that causes air to flow into the bipolar air ionizer through the air inlet, around the electrodes and out of the bipolar air ionizer through the air outlet, thereby creating an air flow; and a straightening vane disposed in the path of the air flow and being configured to attenuate loss-causing air flow patterns in the air flow by redirecting the loss-causing air flow toward a single output direction and to redirect portions of the air flow having a trajectory other than that of the single output direction toward the single output direction, the straightening vane having a plurality of generally uniformly distributed apertures, each aperture having a depth that is a function of the overall open area of the aperture, the straightening vane being positioned over at least one of the air inlet, the air outlet and the electrodes, such that air flowing into the air inlet, air flowing out of the air outlet or air flowing past the electrodes flows through the straightening vane.

17. The air ionizer blower according to claim 16, wherein the air mover is a fan.

18. The air ionizer blower according to claim 17, wherein the fan is a rotary-hub fan or axial fan or tube-axial fan.

19. The air ionizer blower according to claim 16, wherein the straightening vane is formed of a conductive material.

20. The air ionizer blower according to claim 19, wherein the straightening vane is electrically coupled to the voltage source as a sensor to provide feedback control of the voltage source.

21. The air ionizer blower according to claim 16, wherein the straightening vane is formed of an electrically non-conductive material.

22. The air ionizer blower according to claim 16, wherein the loss-causing air flow patterns include at least one of eddy currents, rotational swirls, vortices and non-linear trajectories.

23. The air ionizer blower according to claim 16, further comprising a sensor at the air outlet for sensing ion content of the outlet air, the sensor providing a feedback voltage that controls the voltage source.

24. The air ionizer blower according to claim 16, wherein each of the apertures are one of rectangularly-shaped, circularly-shaped, polygonally-shaped and asymmetrically-shaped.

25. The air ionizer blower according to claim 16, wherein the apertures of the straightening vane are aligned in a grid or a honeycomb.

26. The air ionizer blower according to claim 16, wherein the apertures of the straightening vane are aligned in a symmetrical pattern with respect to the overall shape of the straightening vane.

27. The air ionizer blower according to claim 16, wherein the depth of each aperture is at least two millimeters.

28. The air ionizer blower according to claim 16, wherein the depth of each aperture is at least one-half (½) times the square root of the open area of the aperture.

29. A bipolar air ionizer apparatus comprising:

an air inlet;

an air outlet;

an alternating current (AC) high voltage source;

an electrode electrically connected to the high voltage source and configured to alternately generate positive and negative polarity ions;

an air mover that causes air to flow into the bipolar air ionizer through the air inlet, around the electrodes and out of the bipolar air ionizer through the air outlet, thereby creating an air flow; and a straightening vane disposed in the path of the air flow and being configured to attenuate loss-causing air flow patterns in the air flow by redirecting the loss-causing air flow toward a single output direction and to redirect portions of the air flow having a trajectory other than that of the single output direction toward the single output direction, the straightening vane having a plurality of generally uniformly distributed apertures, each aperture having a depth that is a function of the overall open area of the aperture, the straightening vane being positioned over at least one of the air inlet, the air outlet and the electrodes, such that air flowing into the air inlet, air flowing out of the air outlet or air flowing past the electrodes flows through the straightening vane.

30. The air ionizer blower according to claim 29, wherein the air mover is a fan.

31. The air ionizer blower according to claim 30, wherein the fan is a rotary-hub fan or axial fan or tube-axial fan.

32. The air ionizer blower according to claim 29, wherein the straightening vane is formed of a conductive material.

33. The air ionizer blower according to claim 32, wherein the straightening vane is electrically coupled to the voltage source as a sensor to provide feedback control of the voltage source.

34. The air ionizer blower according to claim 29, wherein the straightening vane is formed of an electrically non-conductive material.

35. The air ionizer blower according to claim 29, wherein the loss-causing air flow patterns include at least one of eddy currents, rotational swirls, vortices and non-linear trajectories.

36. The air ionizer blower according to claim 29, further comprising a sensor at the air outlet for sensing ion content of the outlet air, the sensor providing a feedback voltage that controls the voltage source.

37. The air ionizer blower according to claim 29, wherein each of the apertures are one of rectangularly-shaped, circularly-shaped, polygonally-shaped and asymmetrically-shaped.

38. The air ionizer blower according to claim 29, wherein the apertures of the straightening vane are aligned in a grid or a honeycomb.

39. The air ionizer blower according to claim 29, wherein the apertures of the straightening vane are aligned in a symmetrical pattern with respect to the overall shape of the straightening vane.

40. The air ionizer blower according to claim 29, wherein the depth of each aperture is at least two millimeters.

41. The air ionizer blower according to claim 29, wherein the depth of each aperture is at least one-half (½) times the square root of the open area of the aperture.

* * * * *